United States Patent [19]

Boscov

[11] Patent Number: 4,756,270

[45] Date of Patent: Jul. 12, 1988

[54] HAIR FAIRED CABLES AND METHOD OF MAKING SAME

[75] Inventor: Joseph L. Boscov, Reading, Pa.

[73] Assignee: Berk-Tek, Inc., New Holland, Pa.

[21] Appl. No.: 411,308

[22] Filed: Aug. 25, 1982

Related U.S. Application Data

[63] Continuation of Ser. No. 175,365, Aug. 5, 1980, abandoned.

[51] Int. Cl.[4] ..... F15D 1/10

[52] U.S. Cl. ..... 114/243

[58] Field of Search ..... 114/243; 87/1-13; 174/70 R, 42, 117 F; 139/407, 422, 423, 424, 425 A, 431

[56] References Cited

U.S. PATENT DOCUMENTS

| | | | |
|---|---|---|---|
| 423,713 | 3/1890 | Ashworth | 87/2 |
| 1,164,137 | 12/1915 | Stewart | 139/431 |
| 3,368,514 | 2/1968 | Kelly | 114/243 |
| 3,440,991 | 4/1969 | Cubbage | 114/243 |
| 3,662,787 | 5/1972 | Schiappa et al. | 139/422 |
| 3,975,980 | 8/1976 | Hood | 114/243 |
| 4,159,394 | 6/1979 | Ross | 174/117 F |

*Primary Examiner*—Joseph F. Peters, Jr.
*Assistant Examiner*—Stephen P. Avila
*Attorney, Agent, or Firm*—Peter L. Klempay

[57] ABSTRACT

Cable fairing is formed by weaving a filamentary yarn about one or more insulated conductors with the yarn serving to anchor the conductors in the cable and extending outwardly therefrom to form fairing hairs.

1 Claim, 2 Drawing Sheets

FIG. 1
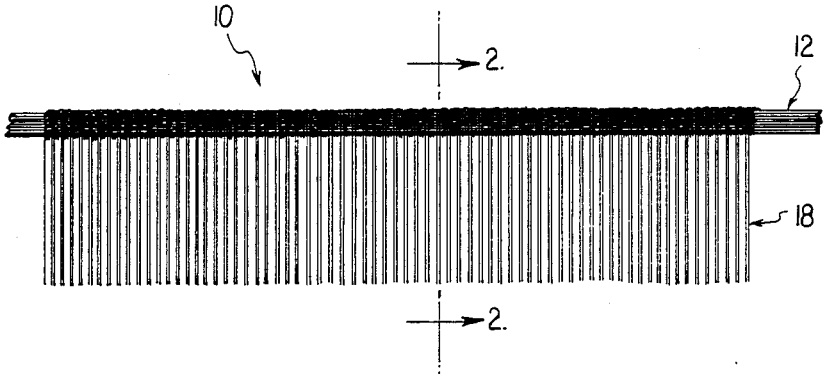
FIG. 2
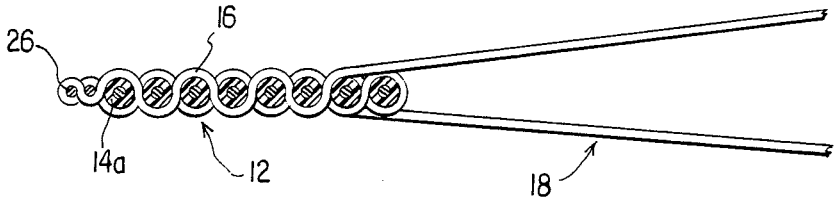
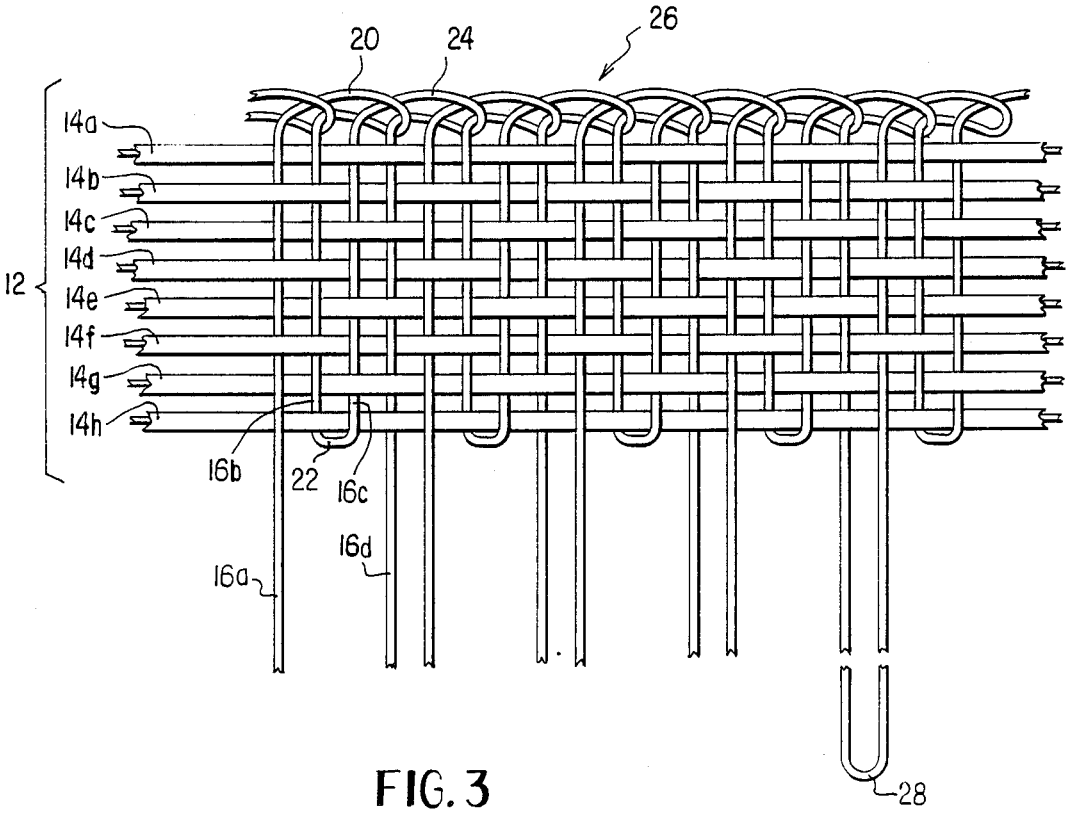
FIG. 3

FIG. 4
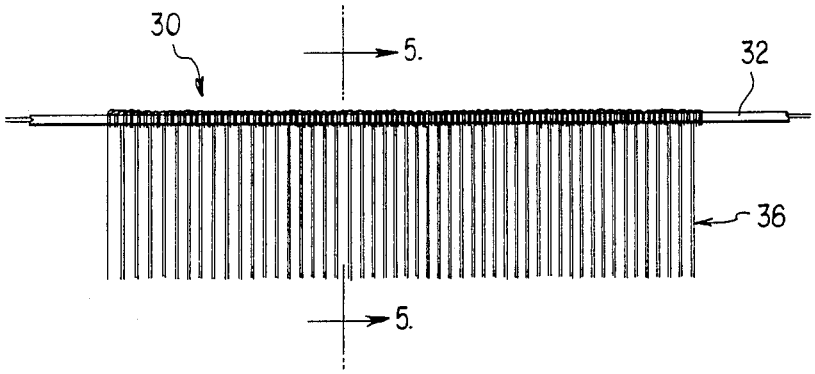
FIG. 5
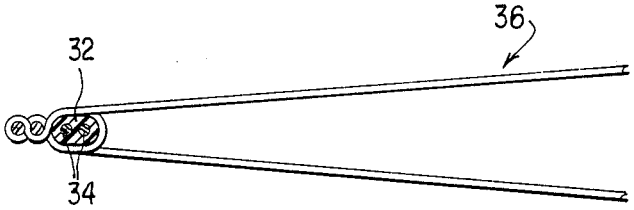
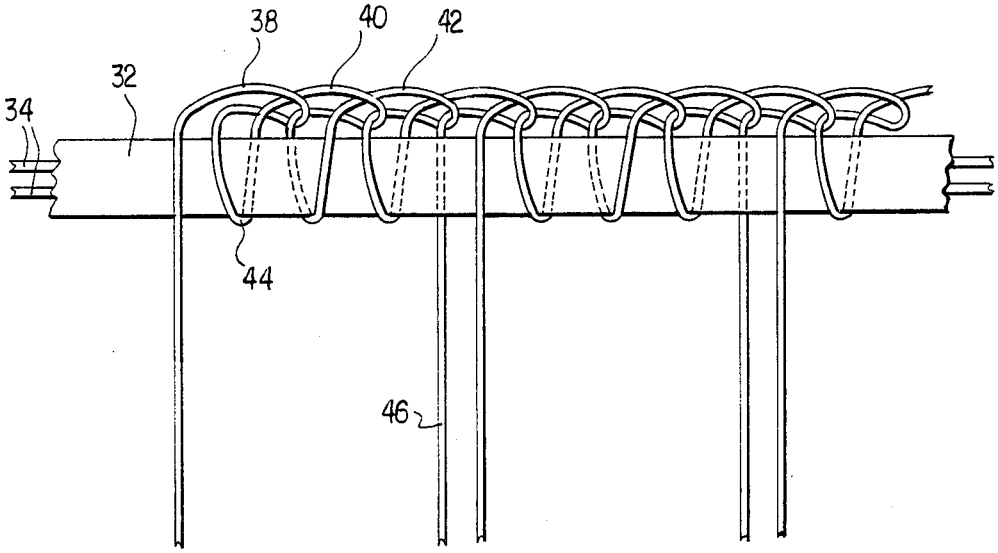
FIG. 6

HAIR FAIRED CABLES AND METHOD OF MAKING SAME

This application is a continuation of application Ser. No. 175,365, filed Aug. 5, 1980, now abandoned.

BACKGROUND OF THE INVENTION

It has been recognized that the undesirable vibration or strumming of an underwater cable can be minimized by providing fairings or filament-like strands extending from the cable. The fairings function as vortex shedders thereby reducing strumming and the cable drag coefficient.

One method taught in the prior art for securing the fairing hairs to cables has been the provision of a woven or braided jacket fully surrounding the cable with the fabric jacket serving as a mesh to anchor the fairing hairs. U.S. Pat. Nos. 3,440,991, Cubbage, and 3,975,980, Hood, are examples of this type of fairing. The manufacture of such cables is, however, relatively complex as provision must be made both for braiding the jacket onto the cable and for supplying and anchoring the separate fairing hairs.

It is an object of the present invention to provide a hair faired cable in which the fairing is formed by a weaving operation which directly attaches the fairing hairs to the cable without need for a separate jacket.

BRIEF SUMMARY OF THE INVENTION

The above and other objects of the invention which will become apparent hereinafter are achieved by weaving together one or more insulated conductors and a filamentary yarn, the conductors serving as the warp and the yarn as the weft in the weaving operation. At intervals along the length of the cable the weft yarns are extended so that they project from the cable thus forming the fairing hairs.

For a more complete understanding of the invention and the objects and advantages thereof, reference should be had to the accompanying drawings and the following specification wherein preferred embodiments of the invention are shown and described.

BRIEF DESCRIPTION OF THE DRAWINGS

In the drawings:

FIG. 1 is a fragmentary plan view of a first embodiment of the hair haired cable of the present invention;

FIG. 2 is a transverse cross-sectional view taken on the line 2—2 of FIG. 1 and on an enlarged scale relative thereto;

FIG. 3 is a schematic diagram of the weaving pattern employed in forming the cable of FIG. 1; and FIGS. 4, 5 and 6 are views corresponding to FIGS. 1, 2 and 3, respectively, but showing a second embodiment of the invention.

DETAILS DESCRIPTION OF THE PREFERRED EMBODIMENTS

Referring now to FIGS. 1–3, there is shown a hair faired multiple conductor cable, designated generally by the numeral 10. The cable consists of a ribbon 12 of insulated conductors 14 with filamentary yarn 16, which may be a nylon filament yarn, interwoven with the conductors. Certain of the yarns 16 extend beyond one lateral edge of the ribbon 12 to provide fairing hairs 18.

A preferred weaving pattern by which the cable 10 is formed can be seen most clearly from FIG. 3. It will be understood, however, that other weaving patterns may also be used. The insulated conductors 14*a–h* constitute the warp of the ribbon 12. Woven across this warp are the filamentary yarns 16 with each weft yarn doing a first and second traverse 16*a* and 16*b*, respectively, of the warp shed to form a first loop 20. Subsequently, the warp is crossed and the weft again does a double traverse 16*c*, 16*d* to form a second loop 24 which is drawn through the opening of the first loop 20. As the weaving continues in this manner the successive loops 20 and 24 serve to form a selvage 26 along one edge of the ribbon. Along the opposite edge of the ribbon, the weft yarn is drawn tight at every second crossing, as indicated at 22. At the alternate crossings the weft yarns extend a substantial distance from the ribbon and it is these yarns that form the fairing hairs. Preferably, the weft yarn at these later crossings form loops 28 which are subsequently cut to form a pair of fairing hairs.

It can thus be seen that the weaving process serves both to form a ribbon-like cable and to provide fairing hairs along the length of the cable in one operation.

A second embodiment of the invention is illustrated in FIGS. 4–6. In this embodiment the cable is formed of a jacketed multiple conductor cable 32, the multiple conductors being indicated at 34. The fairing hairs 36 are secured to the conductor 32 by weaving or lacing the same around the conductor 32 in a pattern equivalent to the weaving pattern of FIG. 3. Thus, the filamentary yarn is laced in a series of loops 38, 40, 42 passing from opposite sides of the conductor 32 and interlaced with one another. Preferably, for three successive loops the yarn is wrapped tightly about the cable 32, as is indicated at 44, whereas on the fourth wrap the yarn forms a loop which may be subsequently cut to form the individual fairing hairs 46.

While preferred embodiments of the invention have been illustrated and described hereinabove, it will be apparent that the invention is not limited to these embodiments. Accordingly, reference should be had to the appended claims in determining the scope of the invention.

What is claimed is:

1. A method of forming a hair faired cable comprising the steps of:

forming a warp of insulated conductors ;

weaving a weft of filamentary yarn on said warp with said yarn forming a continuous selvage along one lateral edge of said cable, and, along the other lateral edge of said cable, alternately forming tight loops whereby said conductors are anchored in said cable and loops extending laterally by a substantial distance of said warp; and cutting said laterally extending loops to form fairing hairs.

* * * * *